United States Patent [19]

Merten et al.

[11] 4,402,634

[45] Sep. 6, 1983

[54] MINERAL MINING INSTALLATION

[75] Inventors: Gerhard Merten, Lunen; Horst Schlusener, Werne; Kunibert Becker, Werl; Herbert Beyer, Werne, all of Fed. Rep. of Germany

[73] Assignee: Gewerkschaft Eisenhutte Westfalia, Fed. Rep. of Germany

[21] Appl. No.: 270,505

[22] Filed: Jun. 4, 1981

[30] Foreign Application Priority Data

Jun. 27, 1980 [DE] Fed. Rep. of Germany ..... 3024216

[51] Int. Cl.[3] ..... E21D 15/44

[52] U.S. Cl. ..... 405/299; 405/291

[58] Field of Search ..... 405/291-302; 299/31-33

[56] References Cited

U.S. PATENT DOCUMENTS

| | | | |
|---|---|---|---|
| 3,448,584 | 6/1969 | Rieschel | 405/299 |
| 3,505,823 | 4/1970 | Bell | 405/301 |
| 4,048,804 | 9/1977 | Elsner et al. | 405/296 X |
| 4,169,689 | 10/1979 | Weirich et al. | 405/291 |
| 4,195,953 | 4/1980 | Becker et al. | 405/300 |
| 4,227,833 | 10/1980 | Plester et al. | 405/291 X |

FOREIGN PATENT DOCUMENTS

| | | | |
|---|---|---|---|
| 2222018 | 11/1973 | Fed. Rep. of Germany | 405/302 |

*Primary Examiner*—Dennis L. Taylor

*Attorney, Agent, or Firm*—Thompson, Birch, Gauthier & Samuels

[57] ABSTRACT

A mineral mining installation comprises a longwall conveyor, and a plurality of roof support units positioned side-by-side along the goaf side of the conveyor. The roof support units are positioned to define an access area between the conveyor and the roof support units. A plurality of hydraulic bracing rams act on the conveyor to brace the conveyor longitudinally. Each of the bracing rams is pivotally attached to a floor sill of a respective roof support unit. The hydraulic bracing rams are positioned at the goaf-side edge portion of the access area. The bracing forces are transmitted from the bracing rams to the conveyor via respective transverse arms attached to the bracing rams and to the conveyor.

20 Claims, 2 Drawing Figures

A
10
12
11
20
31
19
18
18
28
27
30
26
X
29
17
32
17
23
13''
13'
13''
13'
16
23
16
16
16
S
S
21
21
13
13
I
II

MINERAL MINING INSTALLATION

BACKGROUND OF THE INVENTION

This invention relates to a mineral mining installation having a longwall structure, such as a conveyor, and a roof support assembly constituted by a plurality of side-by-side roof support units, at least some of which are provided with hydraulic bracing rams for bracing the longwall structure longitudinally.

In known installations of this type, each bracing ram is pivotally mounted between the longwall structure and the floor sill of one of the roof support units, the rams being inclined at small acute angles to the longitudinal axis of the longwall structure. The floor sills are provided with brackets for the connection of the bracing rams. (see U.S. Pat. No. 4,227,833).

This type of installation, which has bracing rams distributed along the entire length of the longwall structure, has proved satisfactory in practice. Unfortunately, however, the bracing rams are positioned in the access area defined between the longwall structure and the roof support assembly. The bracing rams do, therefore, greatly impede the passage of mine personnel through the access area, and this is particularly troublesome where shallow seams are being won.

The aim of the invention is to provide a mineral mining installation whose longwall structure can be reliably braced in the longitudinal direction, without leading to undesirable congestion of the access area.

SUMMARY OF THE INVENTION

The present invention provides a mineral mining installation comprising a longwall structure and a plurality of roof support units positioned side-by-side along the goaf side of the longwall structure, the roof support units being positioned to define an access area between the longwall structure and the roof support units, and a hydraulic bracing ram acting on the longwall structure to brace the longwall structure longitudinally, the bracing ram being pivotally attached to a floor sill of one of the roof support units, wherein the hydraulic bracing ram is positioned at the goaf-side edge portion of the access area, the bracing forces being transmitted to the longwall structure via a transverse arm attached to the bracing ram and to the longwall structure.

The invention also provides a mineral mining installation comprising a longwall structure and a plurality of roof support units positioned side-by-side along the goaf side of the longwall structure, the roof support units being positioned to define an access area between the longwall structure and the roof support units, and a plurality of hydraulic bracing rams acting on the longwall structure to brace the longwall structure longitudinally, each of the bracing rams being pivotally attached to a floor sill of a respective roof support until, wherein the hydraulic bracing rams are positioned at the goaf-side edge portion of the access area, the bracing forces being transmitted to the longwall structure via respective transverse arms attached to the bracing rams and to the longwall structure.

Thus, in this installation, the bracing rams are positioned at the goaf side of the access area, so that the major portion of the access area remains uncongested by the bracing rams.

Advantageously, the or each transverse arm is positioned at floor-level, and the or each transverse arm is constituted by a trough-shaped plate. Preferably, the or each bracing ram is substantially parallel to the longwall structure when the installation is in its normal working position. Thus, the transverse arms do not reduce the height of the access area to any appreciable extent. The trough-shaped plates which constitute the transverse arms are arranged to have a small depth, and to have their central portions resting on the floor of the working. Despite their small depth, they are sufficiently strong to transmit the bracing forces to the longwall structure.

Preferably, the or each transverse arm is rigidly attached to the longwall structure, and lies substantially at right-angles thereto.

Advantageously, the or each bracing ram is attached to the respective transverse arm by means of a universal joint, and the or each hydraulic bracing ram is attached to the respective floor sill by means of a universal joint. The provision of these universal joints permits the longwall structure to be advanced in the braced condition, without undesirable loads being applied to the bracing rams. Similarly, the roof support units can be advanced, in a follow-up movement, with the longwall structure braced, and without the bracing rams being subjected to undesirable loads.

In a preferred embodiment, a respective hydraulic bracing ram is associated with each of the roof support units.

Where each of the roof support units is provided with an advance mechanism, the advance mechanisms being connected to the longwall structure and being effective to advance the longwall structure and to advance the roof support units in a follow-up movement, the or each transverse arm may form part of the advance mechanism of a respective roof support unit. Advantageously, the or each hydraulic bracing ram is attached to the floor sill of a respective roof support unit, the transverse arm associated with that bracing ram forming part of the advance mechanism of an adjacent roof support unit. In this case, alternate roof support units are preferably provided with hydraulic bracing rams attached to their floor sills, the transverse arms associated with the hydraulic bracing rams forming part of the advance mechanisms of the other roof support units. With this arrangement, separate transverse arms are not required. Conveniently, said other roof support units are spaced further from the longwall structure than the roof support units provided with the hydraulic bracing rams.

Advantageously, each advance mechanism comprises a pair of resilient guide rods and a hydraulic advance ram, the guide rods being slidably guided on the floor sill of the associated roof support unit, the face-side ends of the guide rods being connected to the longwall structure by means of an intermediate member, and the hydraulic advance ram being pivotally mounted between the guide rods and said floor sill. Preferably, the intermediate member of the advance mechanism of each of said other roof support units constitutes the transverse arm associated with the hydraulic bracing ram of a respective adjacent roof support unit.

The guide rods of each advance mechanism may be connected to their intermediate member by means of a pivot joint whose pivotal axis extends substantially perpendicular to the floor of the working. These pivot joints ensure that the roof support units have a sufficient freedom of movement even when the longwall structure is braced. They also ensure that the advance mechanisms of the roof support units are not loaded transversely by the bracing forces.

Preferably, each of the intermediate members constiting a transverse arm is attached to the longwall structure by means of a pivot joint whose pivotal axis extends parallel to the longitudinal direction of the longwall structure. These pivot joints enable the transverse arms (intermediate members) to pivot in a plane perpendicular to the floor of the working, and so permit the roof support units to adapt themselves to unevenness of the floor of the working. At the same time, the lack of freedom to move in a plane parallel to the floor of the working results in reliable transmission of bracing forces.

Alternatively, the intermediate members of the advance mechanisms may be attached to the longwall structure by means of pivot joints which permit a limited degree of three-dimensional play. In this case, the guide rods of each advance mechanism are slidably supported, for movement in the direction of face advance, in guides formed on the floor sill of the associated roof support unit. Moreover, the guide rods are supported transversely of the direction of face advance (that is to say in the longitudinal direction of the longwall structure), so that, despite the three-dimensional play of the pivot joints connecting the transverse arms to the longwall structure, the bracing forces are reliably transmitted.

BRIEF DESCRIPTION OF THE DRAWINGS

Two forms of longwall mineral mining installation, each constructed in accordance with the invention, will now be described, by way of example, with reference to the accompanying drawings, in which.

DESCRIPTION OF PREFERRED EMBODIMENTS

Figure 1:
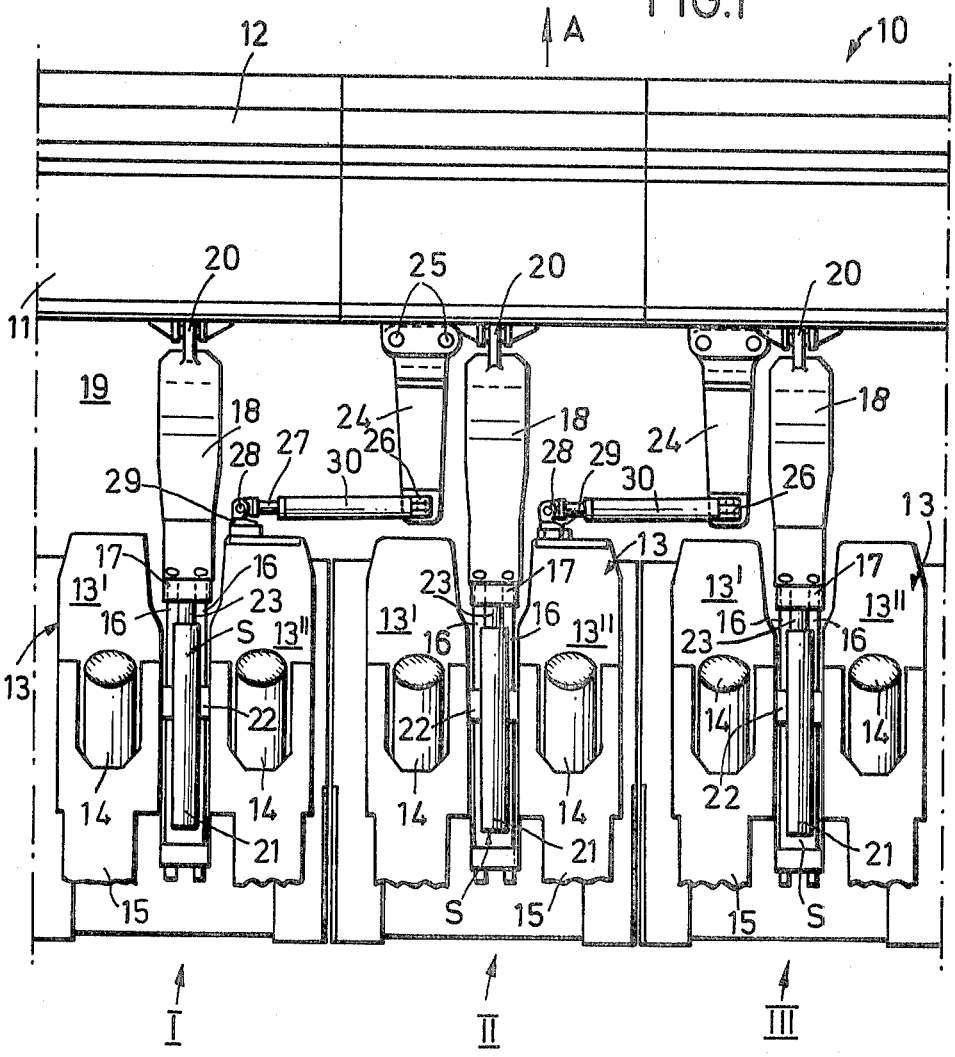
FIG. 1 is a plan view of part of the first form of installation.

Referring to the drawings, FIG. 1 shows part of a longwall mineral mining installation 10 having a scraper-chain conveyor 11 provided with a guide 12 for a winning machine (not shown) such as a plough or a shearer. The installation 10 is positioned adjacent to a mineral work face (not shown), and the guide 12 is mounted on the face side of the conveyor 11. The installation 10 can be advanced, in the direction of the arrow A, as the face is won. Both the conveyor 11 and the guide 12 are formed in sections, so that the installation 10 can be advanced in sections in a so-called snaking movement.

A mine roof support assembly, constituted by a plurality of roof support units I, II, III etc. is positioned on the goaf side of the conveyor 11. Each of the roof support units (only three of which —I, II and III— are shown in FIG. 1) has a floor sill 13 constituted by a pair of laterally-spaced floor girders 13' and 13''. The floor girders 13' and 13'' of each roof support unit support a roof shield (not shown) by means of hydraulic props 14. The roof shield of each roof support unit is connected to the floor girders 13' and 13'' of that unit by means of a goaf shield 15.

Each of the roof support units is provided with an advance mechanism S, the advance mechanism being positioned between the floor girders 13' and 13'' of that roof support unit. Each advance mechanism S has a pair of resilient, generally parallel, guide rods 16. The front (face-side) ends of each pair of guide rods 16 are connected by means of a head-piece 17. Each head-piece 17 is attached to or forms part of, a trough-shaped connecting plate 18, which is connected to the conveyor 11 by means of a pivot joint 20. The trough-shaped plates 18 of the roof support units are disposed in the region between the conveyor 11 and the roof support units, this region defining an access area 19 for mining personnel. The trough-shaped plates 18 each consist of a flat plate which is bent into a trough-shaped configuration, so that its middle portion can bear against the floor of the longwall working, whilst its end portions can be connected respectively to the conveyor 11 and the corresponding advance mechanism S. The pivot joints 20 have their pivot axes parallel to the longitudinal direction of the conveyor 11, and are such that a limited degree of three-dimensional play between the plates 18 and the conveyor 11 is permitted. Each advance mechanism S is provided with a double-acting hydraulic advance ram 21, which is positioned above the two guide rods 16 of that advance mechanism. The cylinder of each ram 21 is connected to the two floor girders 13' and 13'' of the associated roof support unit by means of a cross-piece 22; and the piston rod 23 of each ram 21 is connected to the associated head-piece 17 (or to the associated trough-shaped plate 18). The guide rods 16 are pivotable relative to their floor girders 13' and 13'' in a plane perpendicular to the floor of the working, so that the floor girders can adapt themselves to unevenness in the floor of the working.

The guide rods 16 of each advance mechanism S are slidably guided for movement in the advance direction A in guide (not shown) formed on the mutually-facing side surfaces of the floor girders 13' and 13'' of the associated roof support unit. The cross-piece 22 of each advance mechanism is arranged to slide along the guides formed on the mutually-facing side surfaces of the floor girders 13' and 13''. Thus, when the advance rams 21 are extended, the installation 10 is advanced towards the work face (in the direction of the arrow A) by means of the advance mechanisms S and the trough-shaped plates 18. The roof support units form an abutment for this advance movement, as their hydraulic props 14 are extended to anchor the units firmly between the roof and the floor of the working. Similarly, when the rams 21 are retracted, the individual roof support units are advanced, in a follow-up movement, in the direction of the arrow A. Obviously, the hydraulic props 14 of the roof support units are relieved of load to enable this advance movement to occur. The installation 10 provides an abutment for the follow-up advance movement of the roof support units. During the advance of the roof support units, the roof support units are guided by their guide rods 16.

In order to brace the installation 10 in its longitudinal direction, hydraulic bracing rams 30 are provided, each of which is fitted between a respective roof support unit and the installation. The hydraulic bracing rams 30 are distributed over the entire length of the installation 10. Alternatively, the rams 30 can be distributed over part only of the length of the installation 10 (for example, the rams 30 may be positioned only at the ends of the installation). Each ram 30 is supported on the floor sill 13 of a respective roof support unit. As shown in FIG. 1, each bracing ram 30 is associated with a transverse arm 24 which is rigidly secured to the goaf side of the conveyor 11 by means of bolts 25. The transverse arms 24 extend substantially at right-angles to the longitudinal direction of the installation 10. Each transverse arm 24 is connected to the cylinder of its associated bracing ram 30 by means of a universal joint 26. The joints 26 permit relative pivotal movement between the transverse arms 24 and their rams 30 about axes extending in the direction of the arrow A, as well as about axes at right-angles thereto and perpendicular to the plane of the work face. The piston rods 27 of the rams 30 are connected to their respective floor sills 13 by means of pivot joints 29, whose pivot axes 28 extend substantially perpendicular to the floor of the working. The pivot joints 29 are attached to the front (face-side) ends of the respective floor girders 13'', and are themselves pivotable about axes extending in the advance direction A. Thus, each bracing ram 30 is connected to its floor sill 13 in such a manner as to permit pivotal movement both in the plane perpendicular to the floor of the working, and in the plane parallel with the floor of the working.

Each of the transverse arms 24 is constituted by a trough-shaped plate. These trough-shaped plates are similar to the plates 18, and so have their middle portions in engagement with the floor of the working. The transverse arms 24 have a length such that their joints 26 are positioned at the goaf side of the access area 19. Thus, when the roof support units are in their normal working position, the bracing rams 30 lie in front of, and adjacent to, the floor sills 13 of the roof support units, with the rams 30 extending substantially parallel to the longitudinal direction of the installation 10. Extension of the bracing rams 30 thus causes bracing forces to be transmitted to the installation 10 via the transverse arms 24. This results in the installation 10 being braced longitudinally.

It will be apparent that the bracing means 30, 24 are such that bracing can occur without any appreciable constriction of the access area 19. This is because the rams 30 are positioned at the extreme goaf-side edge of the access area, and the transverse arms 24 are positioned on the floor of the working. When the installation 10 is advanced in the direction of the arrow A, the rams 30 pivot about their joints 26 in a plane parallel to the floor of the working. When the installation 10 has been fully advanced, the bracing rams 30 lie at an acute angle to the longitudinal axis of the installation 10. Obviously, when the roof support units are advanced in a follow-up movement, the bracing rams 30 return to the position shown in FIG. 1.

Figure 2:
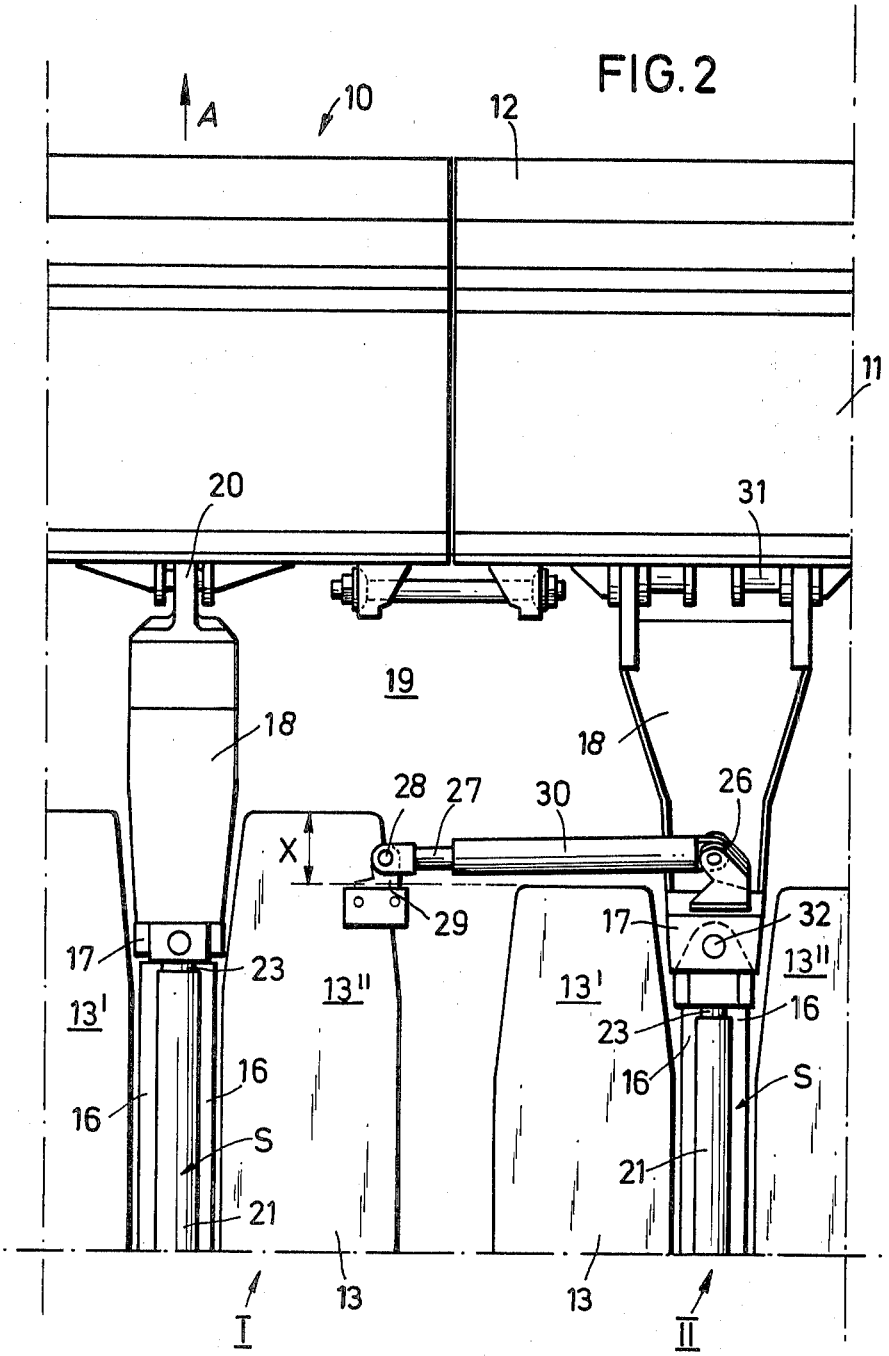
FIG. 2 is a plan view of part of the second form of installation.

FIG. 2 shows part of a modified form of installation 10, in which the bracing force of each hydraulic bracing ram 30 is transmitted to the installation via the advance mechanism S of an adjacent roof support unit. In other words, the trough-shaped plate 18 of the adjacent roof support unit fulfils the function of the transverse arm 24, as well as forming part of the advance mechanism S. In other respects, the arrangement of FIG. 2 is similar to that of FIG. 1, so like reference numerals have been used for like parts.

FIG. 2 shows two roof support units I and II. The roof support unit I is attached to the piston rod 27 of a hydraulic bracing ram 30, by means of a pivot joint 29 whose pivot axis 28 extends substantially perpendicular to the floor of the working. The cylinder of the ram 30 is connected to the trough-shaped plate 18 of the advance mechanism S of the roof support unit II by means of a universal joint 26. The roof support units I and II alternate along the installation 10, so that every other roof support unit is attached to a respective hydraulic bracing ram 30.

The trough-shaped plate 18 of each roof support unit II is connected to the goaf side of the conveyor 11 by means of a pivot joint 31, the pivotal axis of which extends parallel to the longitudinal axis of the conveyor. Thus, these trough-shaped plates 18 can pivot, in the plane perpendicular to the floor of the working, relative to the installation 10. On the other hand, these trough-shaped plates 18 are connected to the conveyor 11 in such a manner that even limited pivotal movement in a plane parallel to that of the floor of the working is not permitted. Each of the roof support units I is attached to the conveyor 11 by means of a pivot joint 20 which permits a limited degree of three-dimensional play between the respective plates 18 and the conveyor 11. As is apparent from FIG. 2, the trough-shaped plates 18 of the roof support units II are somewhat larger than those of the roof support units I.

In the normal working position of the installation 10, each of the roof support units II is set back, by a distance X, towards the goaf relative to the adjacent roof support units I. Moreover, the pivot joints 29, which connect the rams 30 to the floor girders 13'' of the roof support units I, are positioned at the sides of the floor girders 13'' and in the forward (face-side) end zones thereof. Thus, the bracing rams 30 are positioned in front of, and adjacent to, the floor girders 13' of the roof support units II, and to the rear of the forward ends of the floor girders 13'' of the adjacent roof support units I. As with the embodiment of FIG. 1, the bracing rams 30 lie substantially parallel to the longitudinal direction of the conveyor 11, when the installation 10 is in its normal working position.

The guide rods 16 of each of the roof support units II are connected to their trough-shaped plates 18 via a head-piece 17 and a pivot joint 32, the axis of which extends perpendicular to the floor of the working. The provision of the pivot joints 32 permits the roof support units II to move transversely (for example for the purpose of alignment), without this affecting the bracing forces applied to the conveyor 11. Moreover, the provision of the pivot joints 32 permits bracing forces to be transmitted by the bracing rams 30 to the trough-shaped plates 18 of the roof support units II, without transverse forces being applied to the guide rods 16 of the roof support units II.

It will be appreciated that the arrangement described above with reference to FIG. 2 could be modified in a number of ways. For example, the trough-shaped plates 18 of the roof support units II could be attached to the conveyor 11 by means of pivot joints which permit a limited degree of three-dimensional play between these plates and the conveyor. For example, these plates 18 could be connected to the conveyor by means of pivot joints similar to the joints 20 of the embodiment of FIG. 1. Moreover, the arrangement shown in FIG. 2 could be modified by incorporating hydraulic lifting rams in the advance mechanisms S. Such hydraulic lifting rams would enable the entire installation 10 to be tilted so as to alter the cutting horizon of the winning machine which moves along the guide 12. Such hydraulic lifting rams could be fitted between the trough-shaped plates 18 and the conveyor 11 in such a manner that, during tilting movement of the installation 10, the trough-shaped plates are raised away from the floor of the working to a limited extent. In this way, tilting of the installation 10 is possible without affecting the reliable bracing of the installation in the longitudinal direction. Obviously, the arrangement of FIG. 1 could also be modified by incorporating hydraulic lifting rams.

We claim:

1. A mineral mining installation comprising a longwall structure and a plurality of roof support units positioned side-by-side along the goaf side of the longwall structure, the roof support units being positioned to define an access area between the longwall structure and the roof support units, and a hydraulic bracing ram acting on the longwall structure to brace the longwall structure longitudinally, the bracing ram being pivotally attached to a floor sill of one of the roof support units, wherein the hydraulic bracing ram is positioned at the goaf-side edge portion of the access area closely adjacent to the face-side edge of the floor sill of said one roof support unit, the hydraulic bracing ram lying substantially parallel to the longitudinal axis of the longwall structure, and wherein the bracing forces are transmitted to the longwall structure via a transverse arm attached to the bracing ram and to the longwall structure.

2. A mineral mining installation comprising a longwall structure and a plurality of roof support units positioned side-by-side along the goaf side of the longwall structure, the roof support units being positioned to define an access area between the longwall structure and the roof support units, and a plurality of hydraulic bracing rams acting on the longwall structure to brace the longwall structure longitudinally, each of the bracing rams being pivotally attached to a floor sill of a respective roof support unit, wherein the hydraulic bracing rams are positioned at the goaf-side edge portion of the access area closely adjacent to the face-side edges of the floor sills of said roof support units, the hydraulic bracing rams lying substantially parallel to the longitudinal axis of the longwall structure, the bracing forces being transmitted to the longwall structure via respective transverse arms attached to the bracing rams and to the longwall structure.

3. An installation according to claim 2, wherein the longwall structure is a longwall conveyor.

4. An installation according to claim 2, wherein each transverse arm is positioned at floor-level.

5. An installation according to claim 2, wherein each transverse arm is a trough-shaped plate.

6. An installation according to claim 2, wherein each transverse arm is rigidly attached to the longwall structure.

7. An installation according to claim 2, wherein each bracing ram is attached to the respective transverse arm by means of a universal joint, and wherein each hydraulic bracing ram is attached to the respective floor sill by means of a universal joint.

8. An installation according to claim 2, wherein a respective hydraulic bracing ram is associated with each of the roof support units.

9. An installation according to claim 2, wherein each of the roof support units is provided with an advance mechanism, the advance mechanisms being connected to the longwall structure and being effective to advance the longwall structure and to advance the roof support units in a follow-up movement.

10. An installation according to claim 9, wherein each transverse arm forms part of the advance mechanism of a respective roof support unit.

11. An installation according to claim 10, wherein each hydraulic bracing ram is attached to the floor sill of a respective roof support unit, the transverse arm associated with that bracing ram forming part of the advance mechanism of an adjacent roof support unit.

12. An installation according to claim 11, wherein alternate roof support units are provided with hydraulic bracing rams attached to their floor sills, the transverse arms associated with the hydraulic bracing rams forming part of the advance mechanisms of the other roof support units.

13. An installation according to claim 12, wherein said other roof support units are spaced further from the longwall structure than the roof support units provided with the hydraulic bracing rams.

14. An installation according to claim 12, wherein each advance mechanism comprises a pair of resilient guide rods and a hydraulic advance ram, the guide rods being slidably guided on the floor sill of the associated roof support unit, the face-side ends of the guide rods being connected to the longwall structure by means of an intermediate member, and the hydraulic advance ram being pivotally mounted between the guide rods and said floor sill.

15. An installation according to claim 14, wherein the intermediate member of the advance mechanism of each of said other roof support units is the transverse arm associated with the hydraulic bracing ram of a respective adjacent roof support unit.

16. An installation according to claim 14, wherein the guide rods of each advance mechanism are connected to their intermediate member by means of a pivot joint whose pivotal axis extends substantially perpendicular to the floor of the working.

17. An installation according to claim 15, wherein each of the intermediate members constituting a transverse arm is attached to the longwall structure by means of a pivot joint whose pivotal axis extends parallel to the longitudinal direction of the longwall structure.

18. An installation according to claim 14, wherein the intermediate members of the advance mechanisms are attached to the longwall structure by means of pivot joints which permit a limited degree of three-dimensional play.

19. An installation according to claim 14, wherein each of the intermediate members is a trough-shaped plate.

20. A mineral mining installation comprising a longwall structure and a plurality of roof support units positioned side-by-side along the goaf side of the longwall structure, the roof support units being positioned to define an access area between the longwall structure and the roof support units, a hydraulic bracing ram extending along the goaf-side edge portion of said access area and being pivotally attached to a floor sill of one of the roof support units, and an arm attached to and extending laterally from said longwall structure across said access area to the goaf-side edge portion thereof, said bracing ram being attached to and acting via said arm to transmit bracing forces to the longwall structure.

* * * * *